US005143193A

United States Patent [19]

Geraci

[11] Patent Number: 5,143,193

[45] Date of Patent: Sep. 1, 1992

[54] AUTOMATED LIBRARY ARTICLE TERMINAL

[76] Inventor: Ronald Geraci, 9653 El Clair Ranch Rd., Boynton Beach, Fla. 33437

[21] Appl. No.: 701,616

[22] Filed: May 14, 1991

Related U.S. Application Data

[63] Continuation of Ser. No. 443,017, Nov. 29, 1989, abandoned, which is a continuation of Ser. No. 213,537, Jun. 30, 1988, abandoned, which is a continuation-in-part of Ser. No. 131,260, Dec. 7, 1987, abandoned, which is a continuation of Ser. No. 801,129, Nov. 22, 1985, abandoned.

[51] Int. Cl.[5] ..... G07F 7/00; G07F 11/62

[52] U.S. Cl. ..... 194/212; 221/88; 414/273; 414/277

[58] Field of Search ..... 194/205, 210, 212, 213; 221/79, 88; 235/381, 383; 364/478, 479; 414/273, 277; 901/17

[56] References Cited

U.S. PATENT DOCUMENTS

| | | | |
|---|---|---|---|
| 1,809,693 | 11/1929 | Hahling . | |
| 1,866,716 | 7/1932 | McCormick et al. . | |
| 2,887,204 | 5/1959 | Giuliano . | |
| 3,302,804 | 2/1967 | Harris | 414/283 |
| 3,457,391 | 7/1969 | Yamamoto . | |
| 3,490,616 | 1/1970 | Castaldi | 414/273 |
| 3,560,715 | 2/1971 | Akamatsu . | |
| 3,978,959 | 9/1976 | Muellner . | |
| 4,153,931 | 5/1979 | Green et al. . | |
| 4,271,440 | 6/1981 | Jenkins | 360/92 |
| 4,300,040 | 11/1981 | Gould et al. . | |
| 4,348,152 | 9/1982 | Takamatsu | 414/273 X |
| 4,414,467 | 11/1983 | Gould et al. . | |
| 4,458,802 | 7/1984 | Maciver | 194/205 |
| 4,507,044 | 3/1985 | Hutchins | 901/17 X |
| 4,519,522 | 5/1985 | McElwee | 221/79 X |
| 4,527,934 | 7/1985 | Blaseck | 414/631 X |
| 4,563,120 | 1/1986 | Josserand | 414/273 |
| 4,598,810 | 7/1986 | Shore | 194/205 |
| 4,654,727 | 3/1987 | Blum | 360/71 |
| 4,668,150 | 5/1987 | Blumberg | 221/88 |
| 4,812,629 | 3/1989 | O'Neil et al. | 235/383 |
| 4,814,592 | 3/1989 | Bradt et al. | 235/381 |

FOREIGN PATENT DOCUMENTS

| | | | |
|---|---|---|---|
| 55-157156 | 12/1980 | Japan | 360/92 |
| 86/06050 | 10/1986 | World Int. Prop. O. | 414/273 |

*Primary Examiner*—F. J. Bartuska

*Attorney, Agent, or Firm*—Trexler, Bushnell, Giangiorgi & Blackstone, Ltd.

[57] ABSTRACT

An automated library article terminal is externally operable by the user, to, through a delivery chute mounted and arranged to deliver articles through an external wall, automatically stock, vend, and selectively accept return of and re-stock, so that they can be re-vended, a plurality of reusable articles each having a unique code. A memory stores information comprising the location of the plurality of articles in the terminal. A control is coupled to the memory and is responsive to operation of the terminal by a user to generate control signals. A vertical track member has a rotational drive responsive to the control signals for revolving the vertical track member about a given axis. A vertical lift member is mounted for vertical movement on the vertical track member. A vertical drive is responsive to the control signals for vertically moving the lift member relative to the vertical track member. An article handling member mounted on the vertical lift member extends and retracts in a generally horizontal direction relative to the vertical lift member and can be manipulated to selectively engage and release one of the articles. A code reader is mounted for reading the code of any article transported by the article handling member to or from the delivery chute and for generating an article code signal representative of the code so read and transmitting the article code signal to the memory.

20 Claims, 13 Drawing Sheets

AUTOMATED LIBRARY ARTICLE TERMINAL

This application is a continuation of Ser. No. 07/443,017 filed Nov. 29, 1989, now abandoned which is a continuation of Ser. No. 07/213,517 filed Jun. 30, 1988, now abandoned, which is a continuation-in-part of Ser. No. 07/131,260 filed Dec. 7, 1987, now abandoned, which is a continuation of Ser. No. 06/801,129 filed Nov. 22, 1985, now abandoned.

BACKGROUND OF THE INVENTION

The present invention relates to a terminal for use in selectively purchasing, renting, and returning articles such as library articles inventoried within the terminal. The terminal apparatus described herein contains an inventory of library articles in the form of VHS and/or Beta format videotape cassettes. However, the terminal apparatus of this invention is adaptable for use with other articles. The articles are to be contained in novel transport cases such those articles not contained in these cases cannot be returned to a terminal.

The rapidly growing home video industry is triggering an increased home use of pre-taped video materials be means of either sale or rental, leading to a continuing need for consumer oriented accessibility in the renting, purchasing and returning of pre-taped video materials. The present invention is directed toward an automated dispensing and receiving apparatus which carries a varied inventory, is easily accessed by the user and is substantially tamper-resistant.

The automated terminal of the present invention provides a vending-type apparatus having a plurality of storage compartments contained within a tamper-proof housing. The storage compartments are aligned such that each compartment has individual coordinates on the horizontal and vertical axes. The housing includes a front panel contained within a front door which offers the user a table of contents containing call numbers for the library inventory, a credit card scan reader, user oriented selection instructions, user oriented finger-operated selection panel and an access opening of a return and delivery chute. The front panel can be opened by an authorized caretaker for updating the table of contents or to service some of the hardware, e.g. for printing receipts, etc. but without access to the articles contained in the terminal. The door, accessible only to authorized service personnel, permits direct access to the inventory and to the mechanical equipment for vending and accepting returns thereof.

A robot arm located inside the housing with access to each of the individual storage compartments operates to retrieve the library articles for use and return the articles to a compartment after use. The robot arm re-programs a computer memory also contained in the housing, with information regarding inventory availability and location, including the location of unoccupied compartments as it moves through its retrieval and return operations.

The terminal of the present invention begins operation as the user places his or her credit card through the card reader slot located on the front panel of the housing. The computer, upon reading the information contained on the user's credit card, activates the selection, panel. The user selects one of three modes of operation; "rental", "purchase", or "return". After mode selection, in the case of videocassette ("tape") inventory, the user may also select the desired tape size "VHS" or "Beta" at terminals which inventory both types (optional with the operator). The user, if purchasing or renting a tape, then selects the desired tape by pressing a corresponding call number located on the table of contents, on the selection finger panel. Upon receipt of this requested information, the robot arm moves to any compartment in which the memory knows the desired tape is stored. The robot arm retrieves the tape (in its storage container) and provides it to the user through the chute located on the front panel. If the user is purchasing the tape, the user's credit card account is charged with the purchase price. If the user is renting the tape the credit card information is retained within the memory awaiting return of the tape by the user.

If, when beginning terminal operation, the user desires to return the tape, the user requests the "return" mode of operation. Upon request of the "return" mode, the chute opens and the user is instructed to insert the used tape (in its storage container) into the chute. An information detector, such as a bar code render, reviews the returned tape. If the information contained on the returned tape (and/or its container) correlates with the information stored in memory and the tape is undamaged, the robot arm retrieves the tape and places it in any unoccupied compartment within the terminal, recording in the computer memory the location of such placement. If, however, the information code contained on the tape is damaged or does not properly correlate, the tape is rejected and returned to the user. The user's credit card account may be charged the purchase price of a tape rejected because of damage.

The present invention provides for an intrusion free environment for the storage of the inventory. Since the robot arm is self-programmable, the authorized caretaker need only insert an identification code and order removal of a specified series of the inventory. The robot arm, activated by the memory, will locate all copies of the specified inventory stored in the compartments and feed those articles to the caretaker through the chute. To reload the inventory, the caretaker then inserts the new articles and the robot arm receives the new articles and places them in unoccupied compartments while recording information regarding each new article and its location (compartment) coordinates in the computer memory.

SUMMARY OF THE INVENTION

Briefly, and in accordance with the foregoing considerations, the invention provides a robotic arm apparatus for use in a machine that is externally operable by the user, to, through a delivery chute mounted and arranged to deliver articles through an external wall of said machine, automatically stock, vend, and selectively accept return of and re-stock, so that they can be re-vended, a plurality of reusable articles each having a unique code, said apparatus comprising: memory means for storing information comprising the location of said plurality of articles in said machine; control means coupled to said memory means and responsive to operation of said machine by a user to generate control signals; a vertical track member; rotational drive means responsive to said control signals for revolving said vertical track member about a given axis; a vertical lift member mounted for vertical movement on said vertical track member; vertical drive means responsive to said control signals for vertically moving said lift member relative to said vertical track member; article handling means mounted on said vertical lift member; means responsive to said control signals for extending and retracting said article handling means in a generally horizontal direction relative to said vertical lift member; means responsive to said control signals for manipulating said article handling means to selectively engage and release one of said articles; code reader means mounted in said machine for reading the code of any article transported by said robotic arm apparatus to or from said delivery chute and for generating an article code signal representative of the code so read and transmitting said article code signal to said memory means; and means coupled to said robotic arm apparatus for generating a signal corresponding to the location of an article and for transmitting said article location signal to said memory means.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

DETAILED DESCRIPTION OF THE PREFERRED EMBODIMENT

Figure 1:
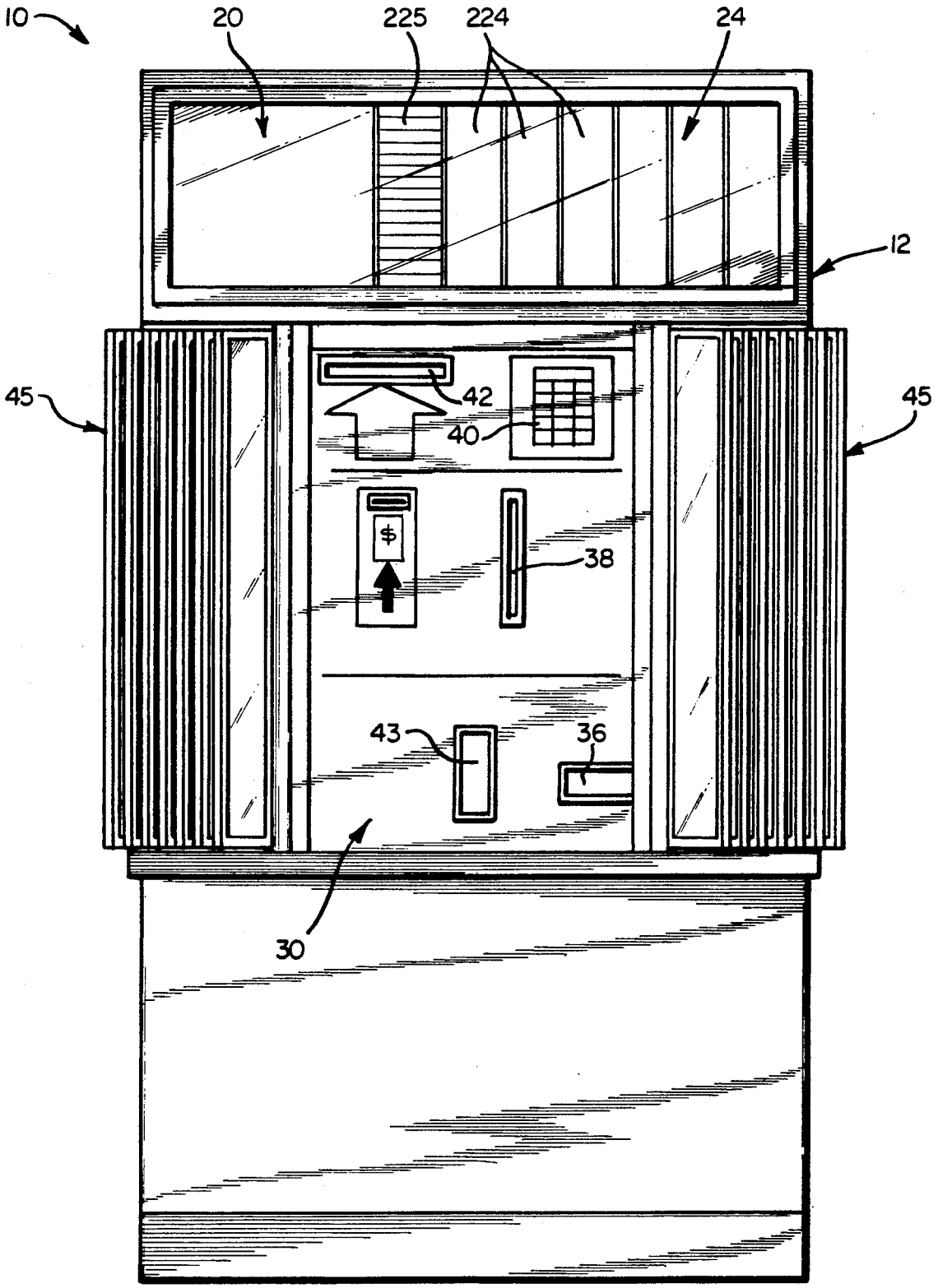
FIG. 1 is a front elevation of the automated terminal apparatus of the invention.
Figure 2:
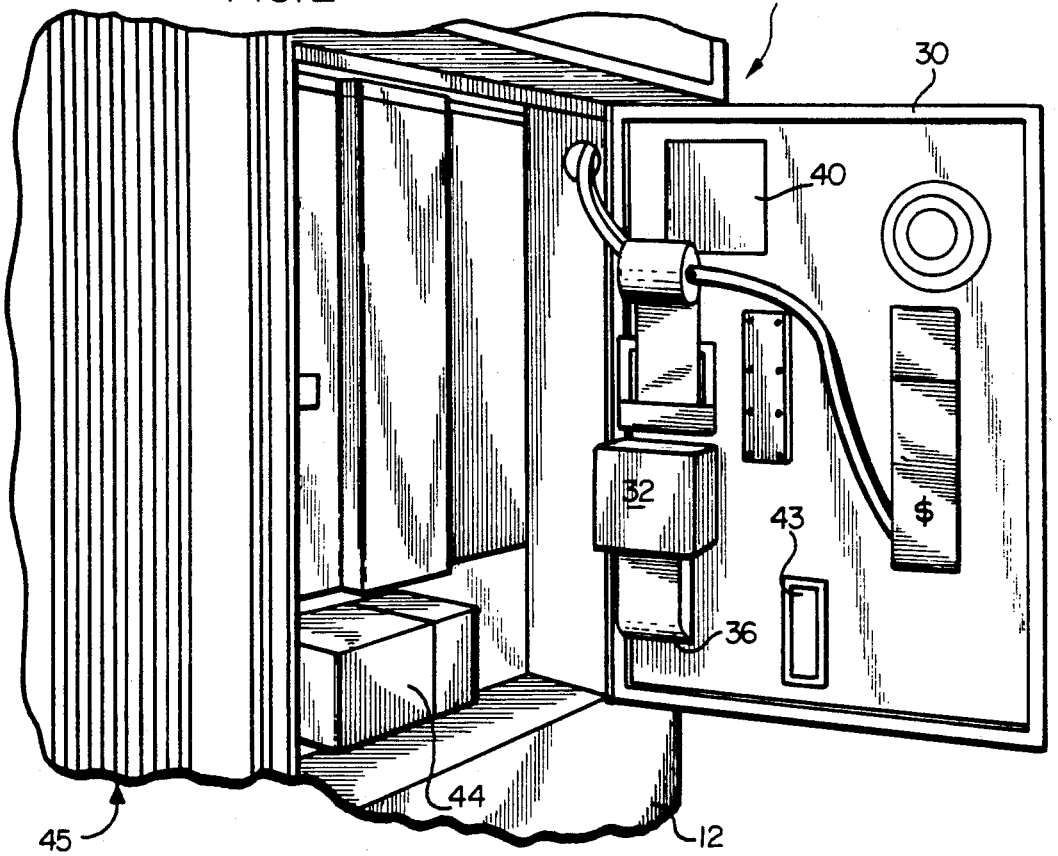
FIG. 2 is a perspective view of a portion of the automated terminal of FIG. 1 showing a first access panel or door member thereof in an open position.
Figure 3:
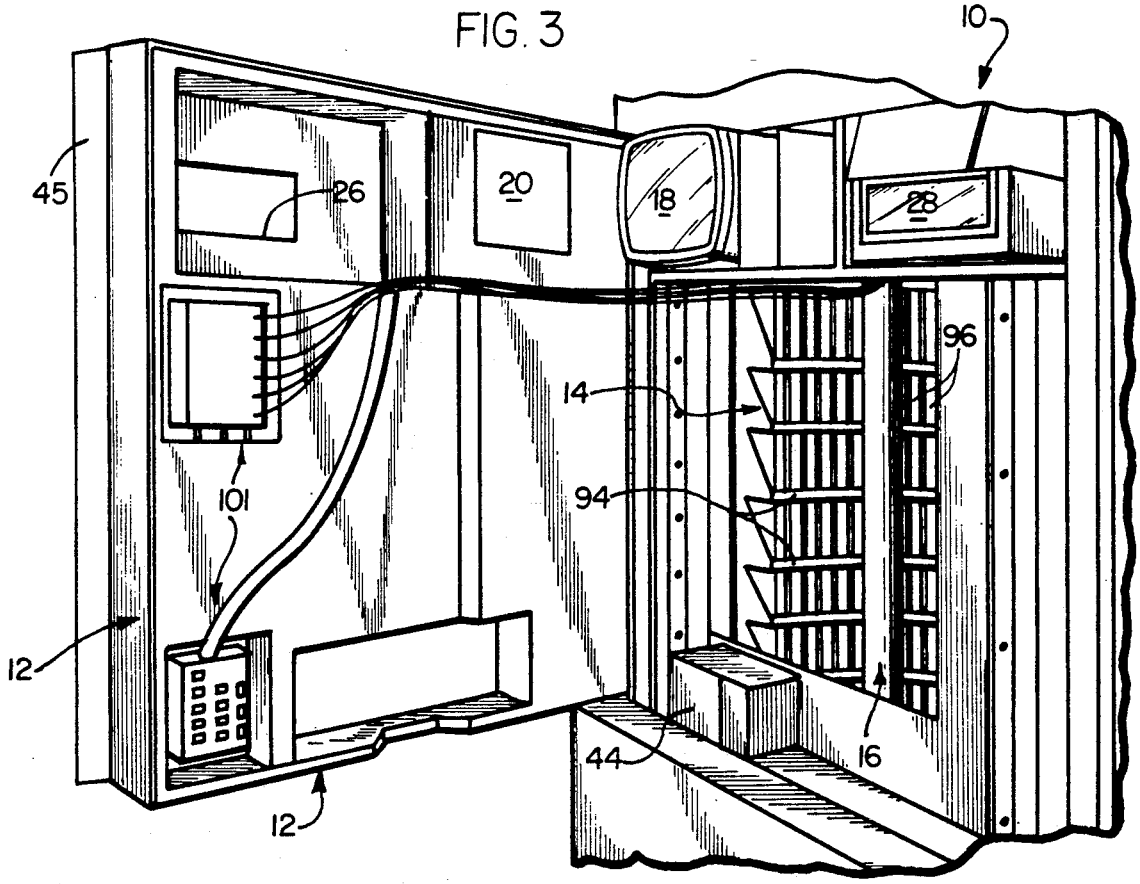
FIG. 3 is a perspective view of the automated terminal of FIG. 1 showing a second access door in an open position.

Referring to FIGS. 1, 2 and 3, the automated terminal of the present invention is shown. The terminal includes a housing 10 having a front door panel 12 hinged to open and provide access to the interior of the housing 10. The housing 10 contains a plurality of storage compartments 14 preferably arranged in a concentrically oriented series of rows. Also located within the interior of the housing 10 is a robot arm 16 which accesses each of the individual compartments 14.

Preferably, access to the housing is limited to authorized service personnel, and the panel 12 is therefore normally inaccessible and is rarely opened, except to service the mechanical components housed within housing 10. For example, inventory is placed in or removed from the compartments 14 by the robot arm 16, without opening the door 12, by a caretaker having the proper codes (preferably in the form of a credit card-like authorization card) to remove and replace inventory. The full operation of the machine will be more fully explained later herein.

In the preferred embodiment, a video-display screen (e.g., a cathode-ray tube) 18 is positioned in an upper front corner of the housing 10. The display screen is intended for use in displaying continuous loop advertising or continuous loop previews of the articles (e.g., motion pictures on videocassettes) contained within the terminal or "coming attractions" of future inventory.

Referring now to the front door panel 12 of the housing 10, a window 20 is provided through which the video display screen 18 is visible. A display panel 24, is provided, on which the titles, catalog information and call numbers of the library inventory are listed. The display panel 24 is designed to be opened by the authorized caretaker in order to update the display information as the inventory of the terminal changes. The display panel 24 is also movable relative to the door 12 to disclose a first access opening 26 through which the tape player 28 can be supplied with a tape cassette for playback on the video display screen 18.

A second smaller access door or panel 30 is also located within and at the front side of the door 12 to provide access to a receipt printer 32 and to enable the attendant to replace the receipt paper 34 on which the information and receipts for rentals and/or purchases is printed. The receipts are provided to the user through the receipt slot 36. Also located on the rear of the door 30 under the display panel 24 and accessible to the authorized attendant are electric circuit components for operating the printer 32.

A credit card magnetic reading slot 38 is located on the outside of the door 30. The card slot 38 enables the user to activate the terminal of this invention for the purpose of purchasing, renting or returning inventoried library articles. A button type finger panel 40 is provided adjacent the card slot 38. The finger panel 40 provides the user with the following functions: selection of the mode of operation of the terminal (i.e., purchase, rent or return); optionally, selection of a videocassette format (i.e., Beta or VHS); and, the ability to select the call number correlating to an article the user wishes to rent or purchase. Instructions for operation of the finger panel 40 are provided in user friendly form on a LED readout 42. A tape delivery and return chute 44 provides the sole user and/or caretaker access to receive or otherwise remove an article from the terminal or to return or otherwise deliver an article to the terminal through its access opening 43.

An additional plurality of "flip-card" mounting racks 45 are also provided hingedly mounted to either side of the panel or door 30. These flip-card racks are adapted to contain the printed boxes or other similar film promotional material briefly describing and/or promoting the various cassettes available within the terminal.

Figure 4:
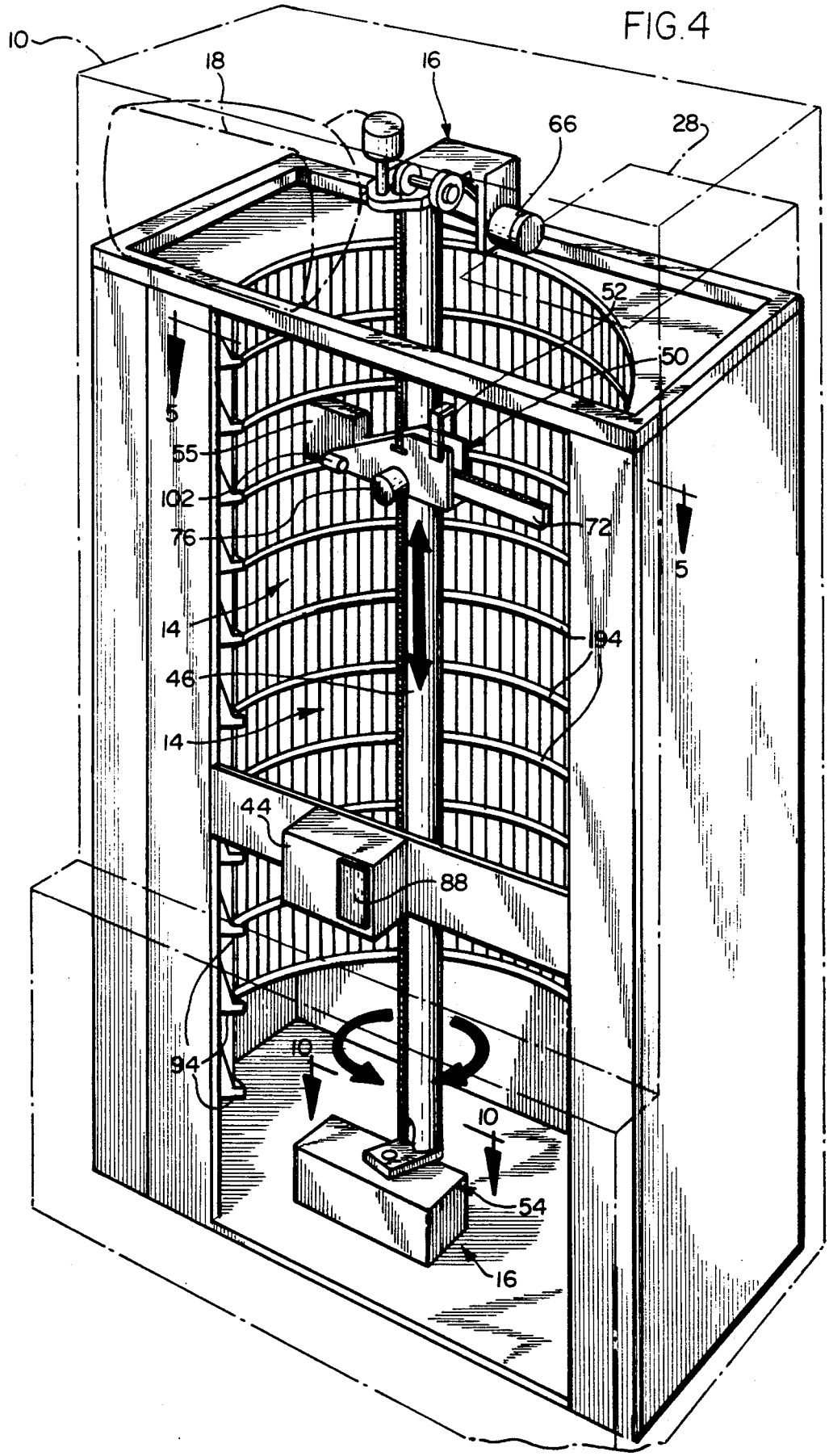
FIG. 4 is a perspective view showing, somewhat diagrammatically, the interior of the automated terminal of FIG. 1, including a robotic arm portion, storage compartments and a delivery chute.
Figure 9:
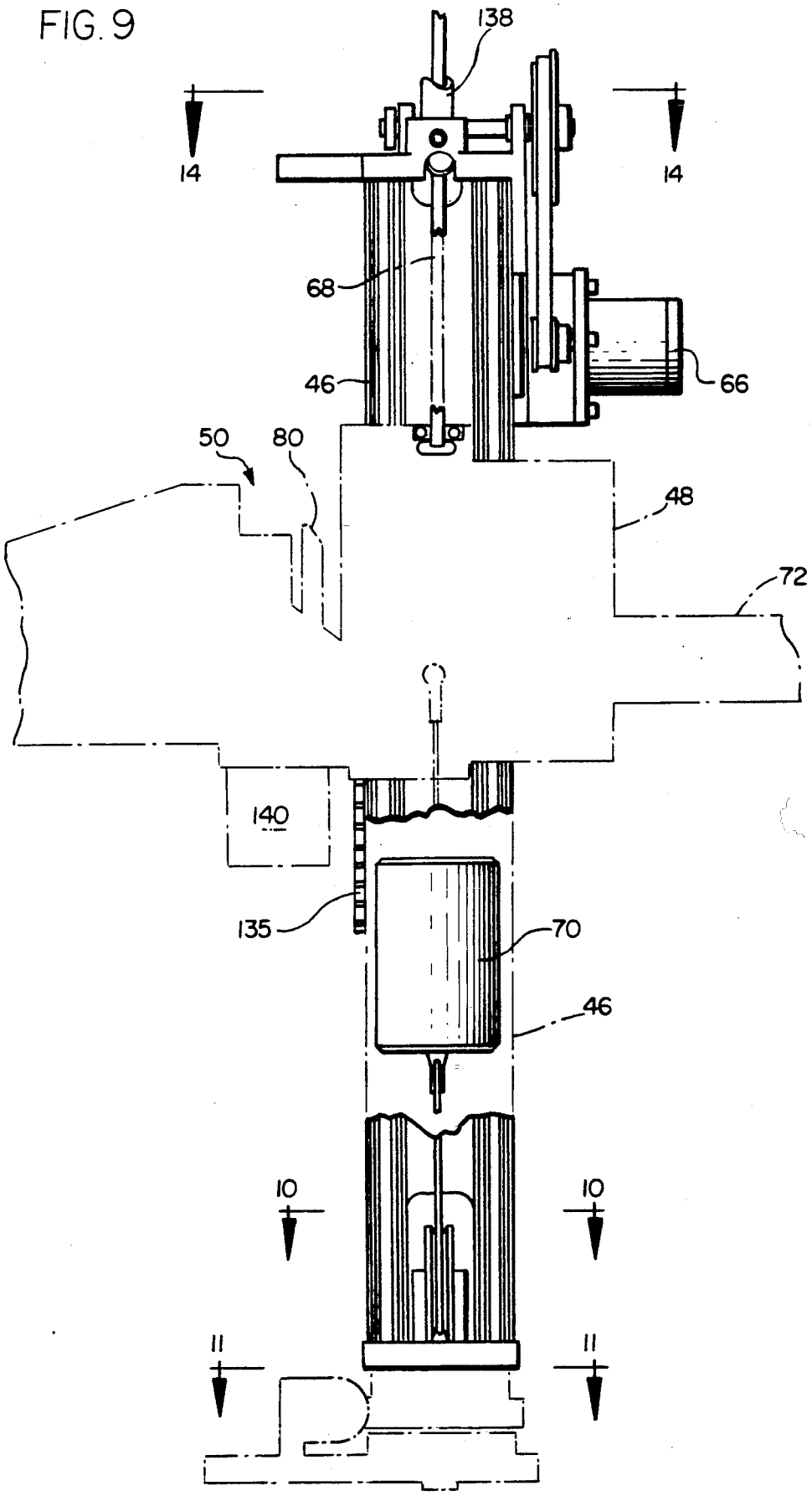
FIG. 9 is an enlarged elevational view illustrating a vertical track portion and related elements of the robotic arm of FIG. 4.

Referring now to FIGS. 4 and 9, the robot arm will be briefly described. The robot arm 16 includes a hollow-core vertical track member 46 which extends the full vertical length of the housing 10. The track member 46 is located, preferably coaxially, within the inner diameter of the concentric stack of compartments 14 and is fixed for revolution about a vertical axis. A vertical lift member 48 is mounted on the vertical track member 46 and is movable the full vertical length of the track member 46. The vertical lift 48 carries an article handling means or member 50. The article handling member 50 is used to retrieve and transport the library articles (e.g , videocassettes in storage containers) housed in the individual compartments. Also mounted on the vertical lift 44 is an optical, electronic bar code reader 52. The bar code reader is adapted to read a bar code information strip located on each videocassette and/or its container 55 (see also FIG. 16).

Figure 10:
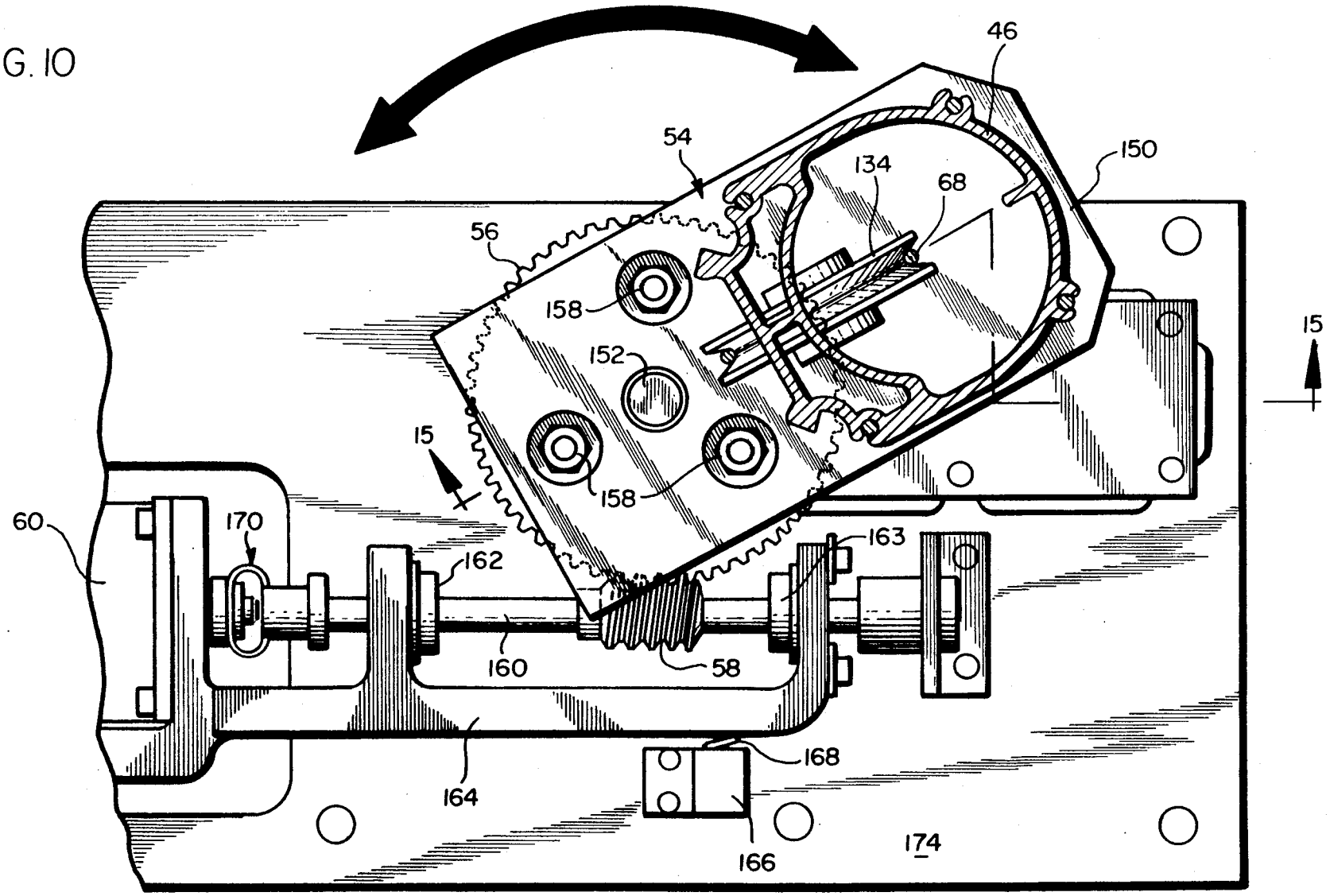
FIG. 10 is an enlarged partial sectional view taken generally in the plane of the line 10—10 of FIGS. 4 and 9.
Figure 11:
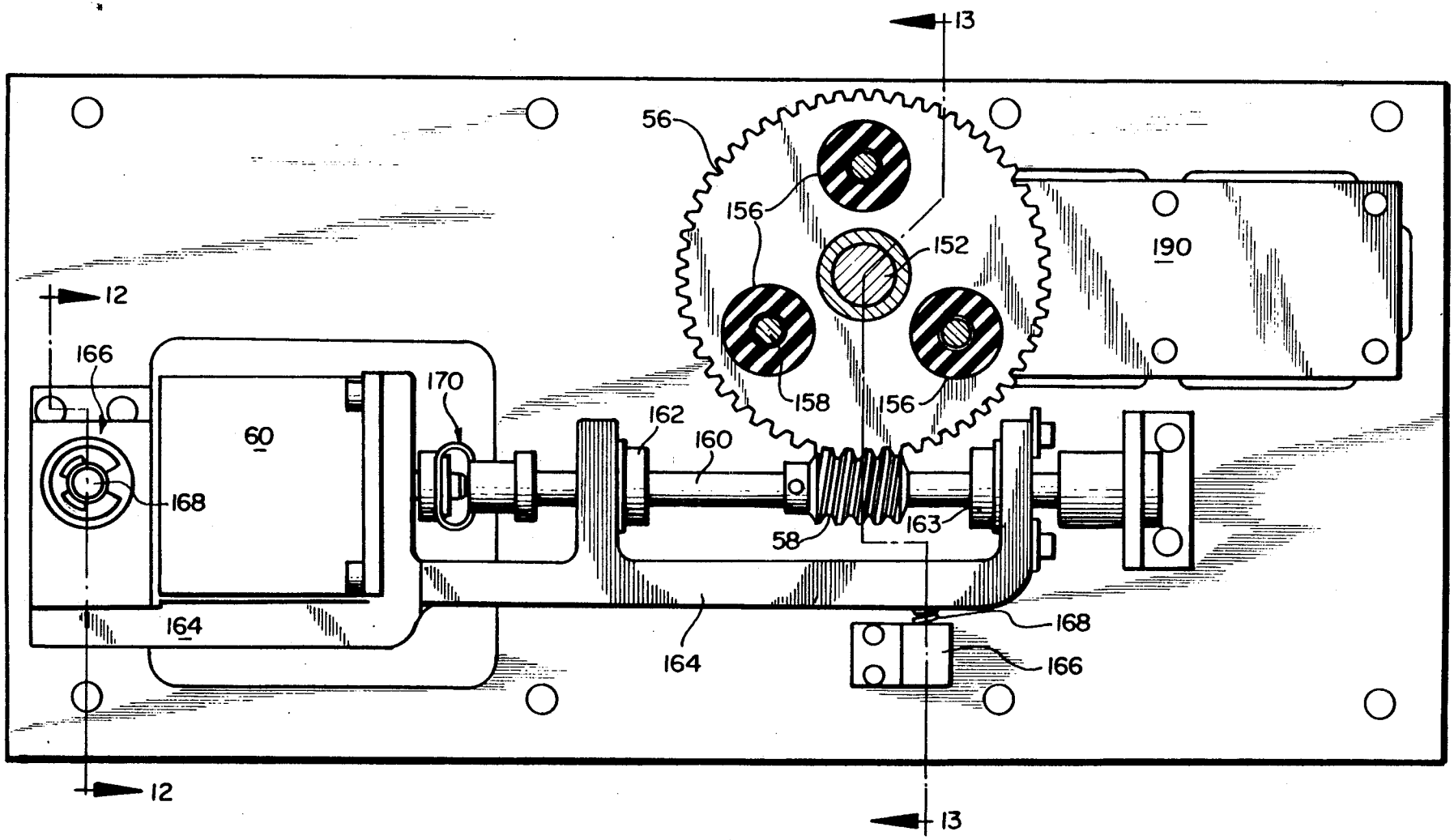
FIG. 11 is a sectional view taken generally in the plane of the line 11—11 of FIG. 4.

The vertical track member 46 is positioned for revolution about the vertical axis on revolving assembly 54. Referring briefly to FIGS. 10 and 11, the revolving assembly 54 comprises a large gear member 56 driven by a worm gear 58 and a motor 60.

Figure 14:
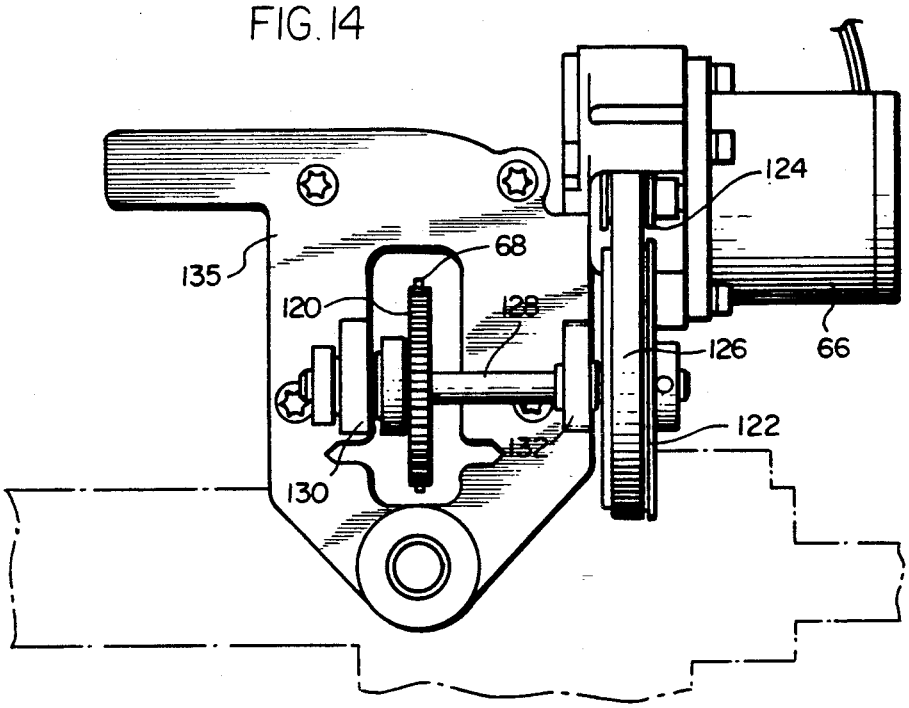
FIG. 14 is a partial top plan view taken generally along the line 14—14 of FIG. 9.

Referring briefly to FIGS. 9 and 14, the vertical lift 48 is driven by a motor 66, belt 68, and counterbalance 70. In the preferred embodiment, the counterbalance 70 travels through the hollow core of the track member 46 in opposition to the lift member 48.

Figure 16:
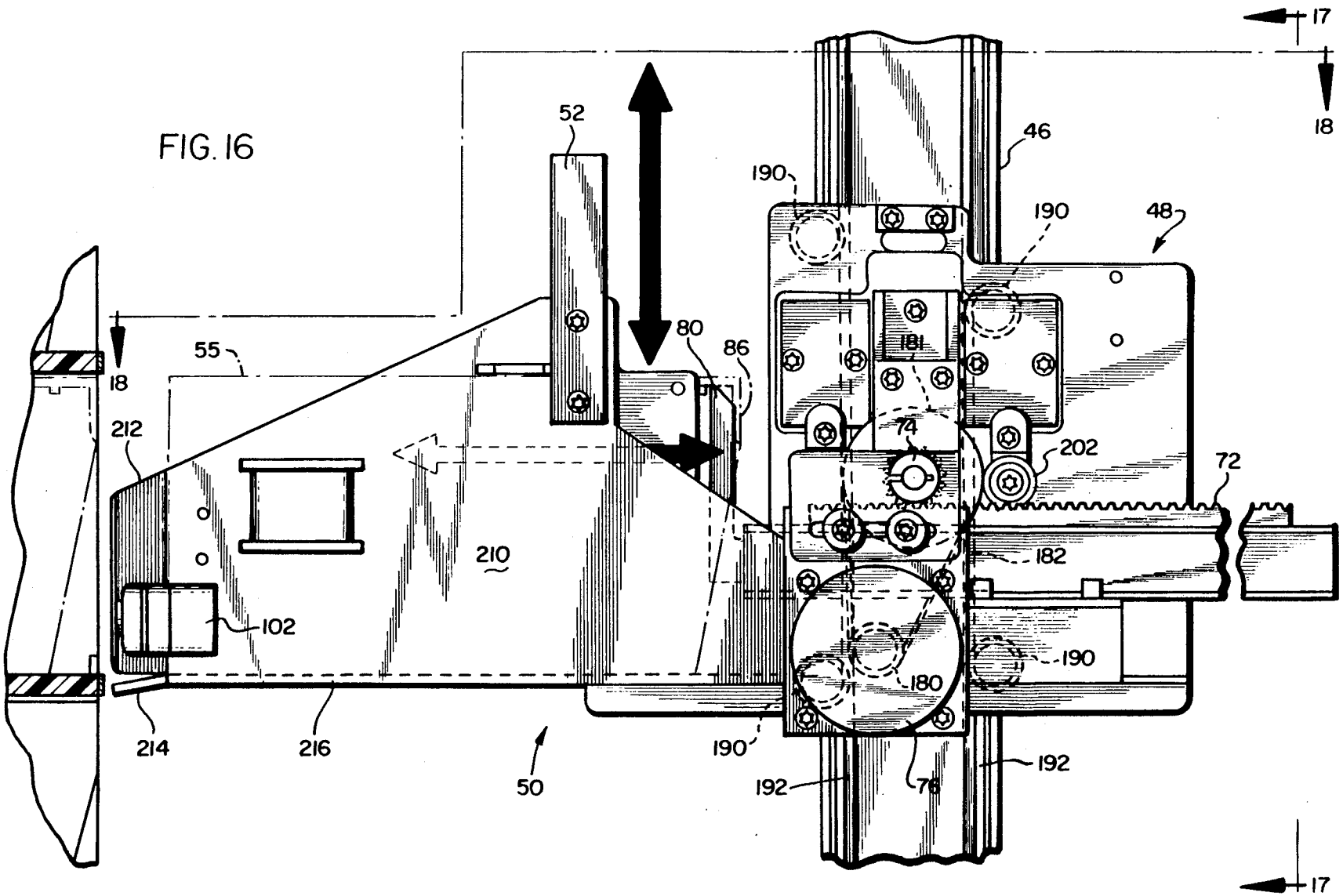
FIG. 16 is a side elevational view of an article handling means or apparatus portion of the robotic arm of FIG. 4.
Figure 17:
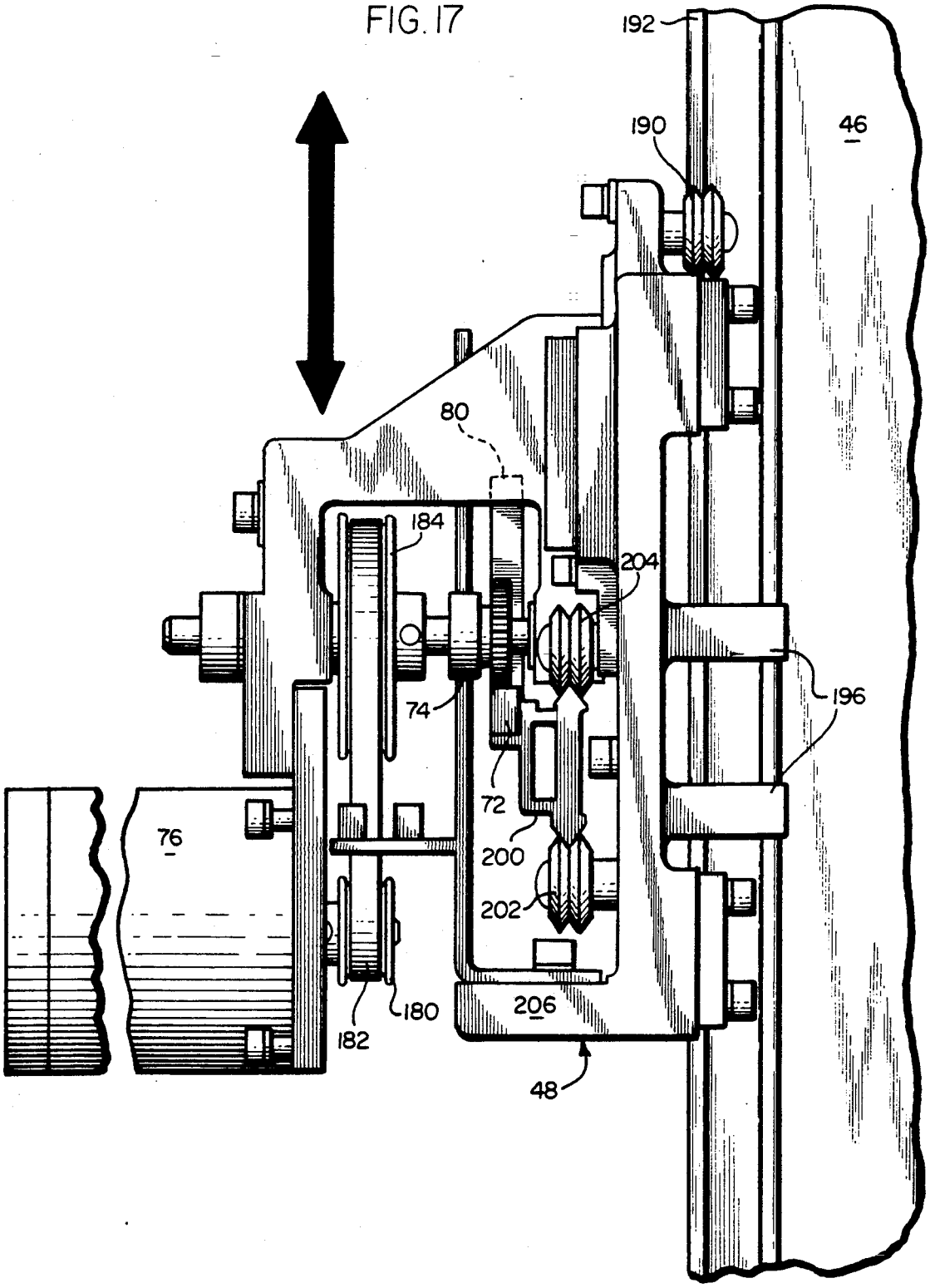
FIG. 17 is an end view taken generally along line 17—17 in FIG. 16.
Figure 18:
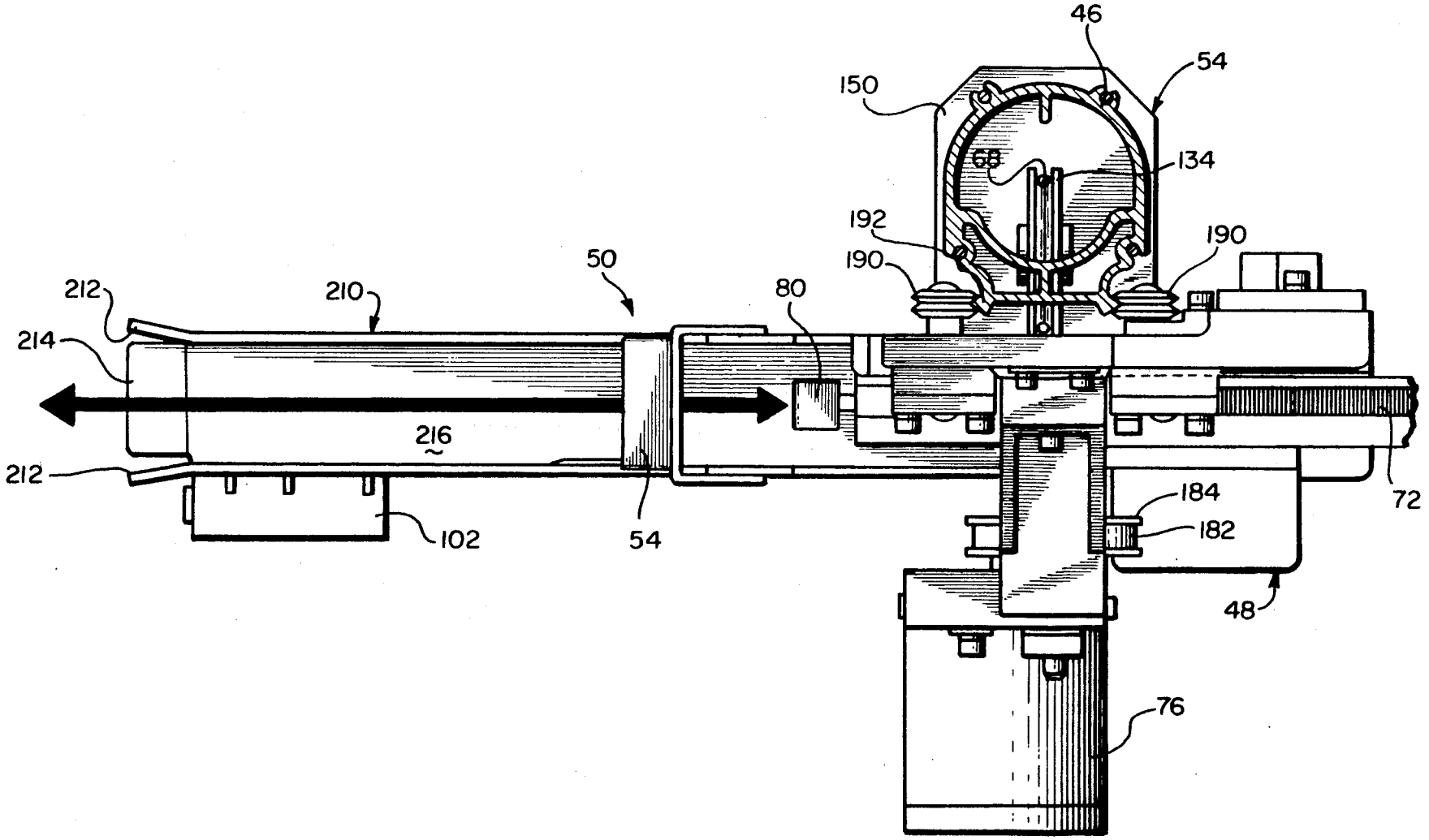
FIG. 18 is a top plan view taken generally along the line 18—18 of FIG. 16.

Referring briefly to FIGS. 16–18, the article handling member 50 is mounted for horizontal movement on the vertical lift 48. The horizontal movement is provided by means of a rack 72 and pinion gear member 74. The pinion gear member 74 is driven by a motor 76.

The article handling member 50 includes an L-shaped hook-like finger 80. Upon activation, the finger 80 is driven through the coordination of motor 76 and motor 66 into a position wherein it enters a "handle" or lip-like overhang 86 of the library article container or case 55. Thus further movement horizontally of finger 80 pulls or pushes the case 55 therewith.

Figure 7:
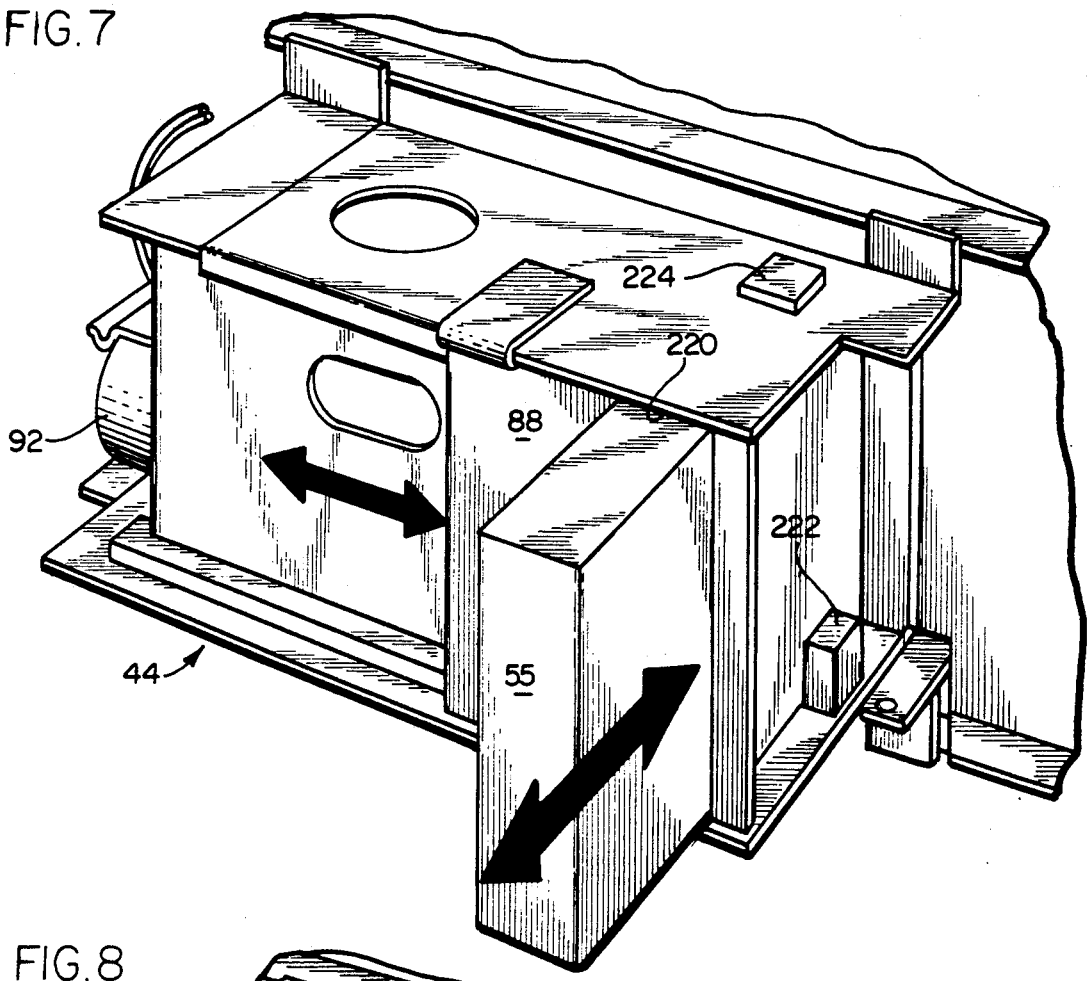
FIGS. 7 and 8 are enlarged front perspective views, somewhat diagrammatic in form, illustrating operation of the delivery chute.
Figure 8:
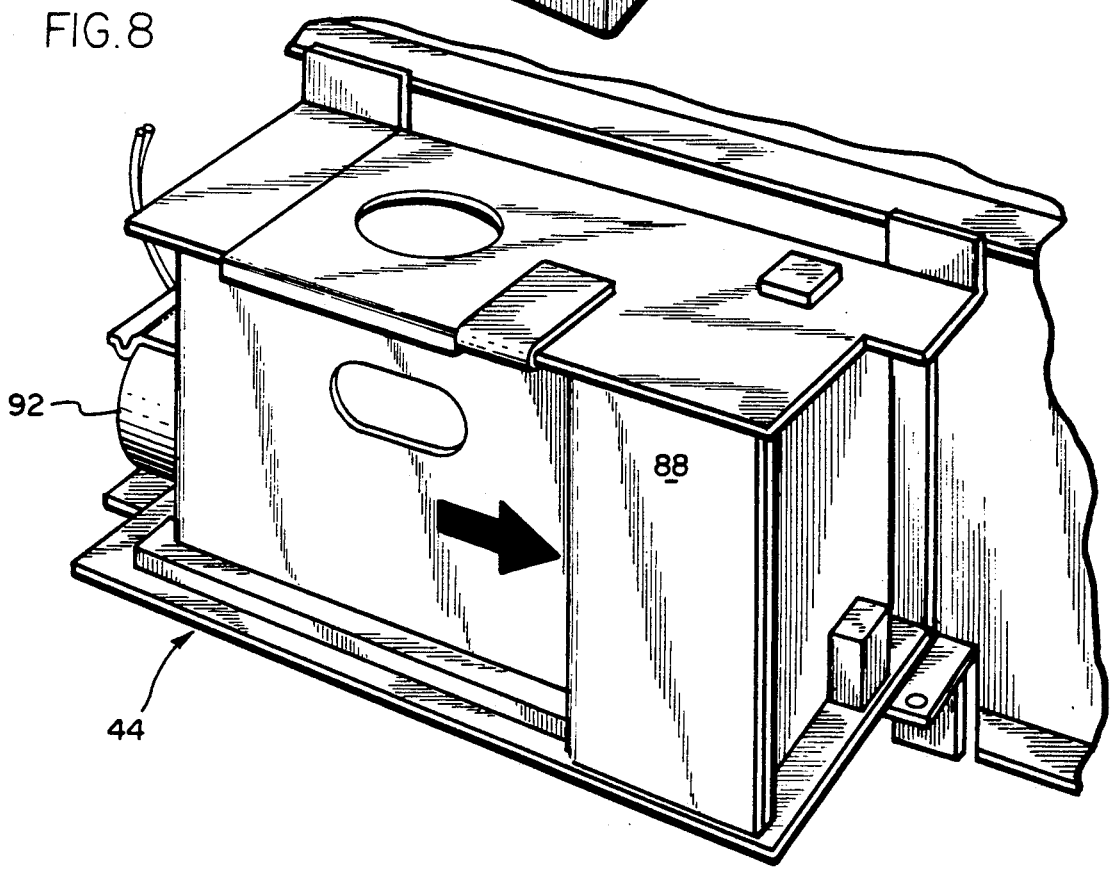

Referring briefly to FIGS. 7 and 8, the chute 44 of the present invention is shown in further detail. The chute 44 includes a sliding door or cover member 88 which is operated by a motor 92 and linkage arrangement (not shown). The door 88 of the chute 44 remains locked in the closed position as shown in FIG. 8 until a user submits information from his credit card by way of the credit card slot 38. Upon receipt of the desired information from the credit card, the motor 92 is activated to operate the linkage and open the door 88. Once the door 88 is open, the robot arm 16 will provide a videocassette in its case 55 through the chute 44 to the user, or the user may return a case 55 containing a videocassette to the inventory if desired.

Figure 5:
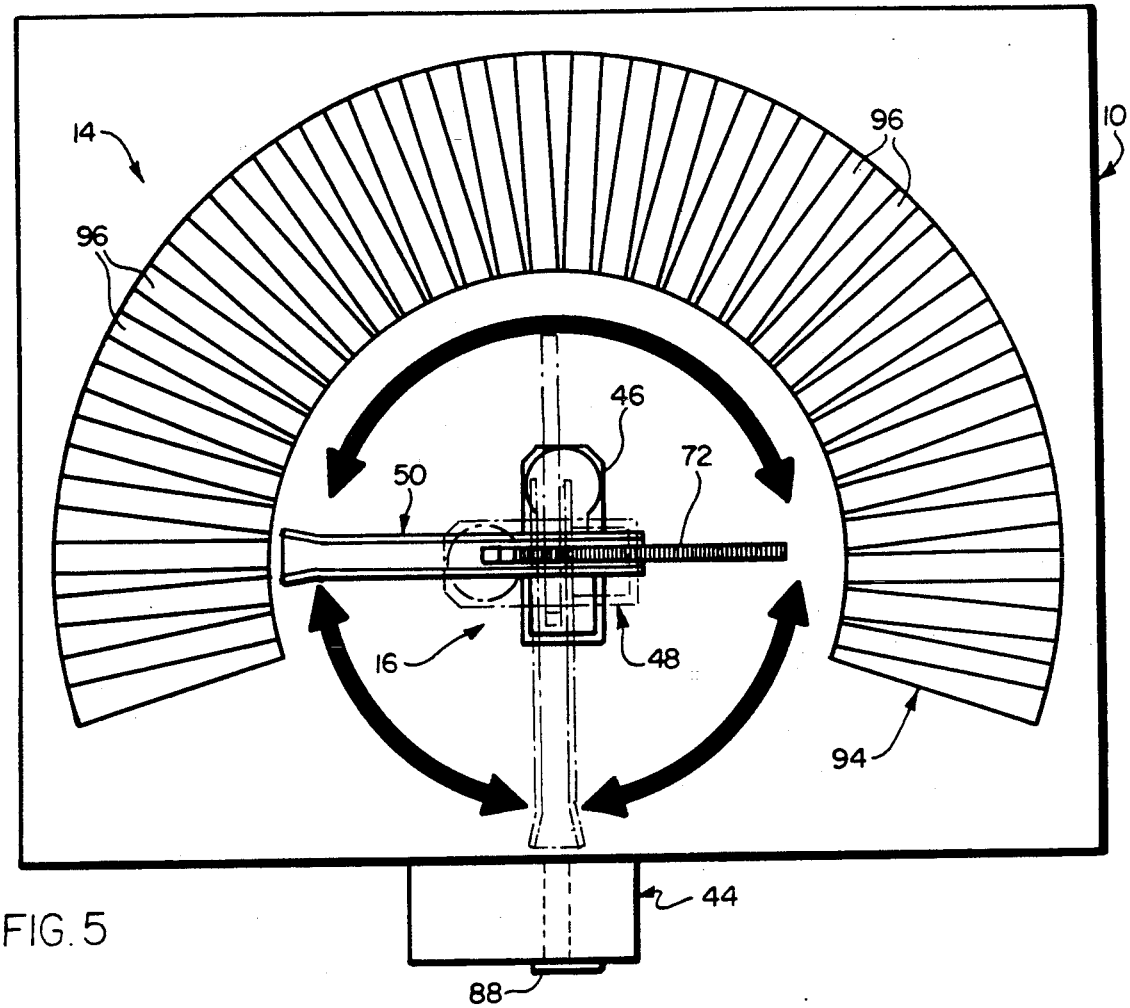
FIG. 5 is a somewhat enlarged and simplified sectional view taken generally in the plane of the line 5—5 of FIG. 4 and illustrating somewhat diagrammatically, operation of the robotic arm with respect to the storage compartments and delivery chute.
Figure 6:
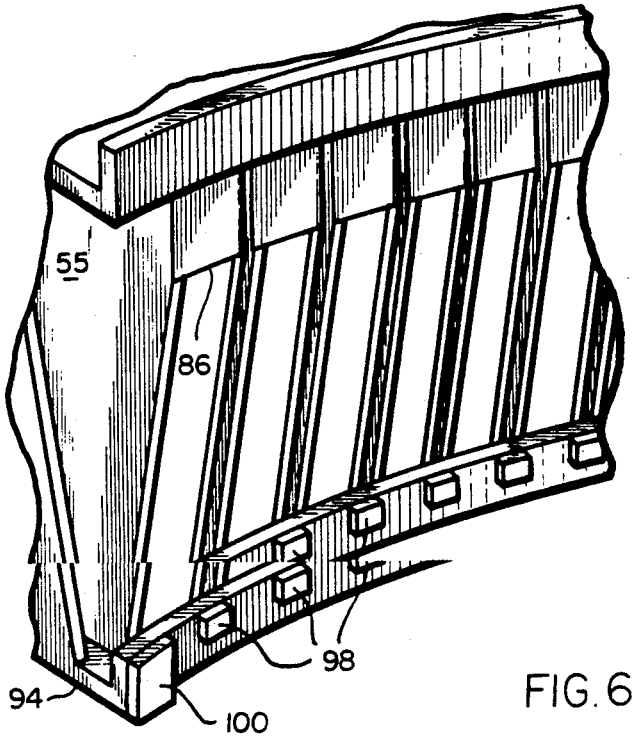
FIG. 6 is an enlarged partial perspective view illustrating further features of the storage compartments.

Referring now to FIGS. 5 and 6, the storage compartments 14 of the present invention are shown in further detail. The compartments comprise a plurality of concentrically arranged, stacked trays 94. Each tray 94 includes a plurality of article (e.g., a videocassette or "tape" in a case) acceptance lots 96. Each slot 96 is individually accessible by the robot arm 16 and article handling member 50. The individual slots 96 have individual coordinates programmed into the memory of a computer which may be on-board as diagrammatically indicated at 101 (FIG. 3), or accessed remotely via a modem, or some combination thereof. As the robot arm places an article in a specific slot or removes an article from a specific slot, the memory automatically re-programs the data relating to the article contained in the slot 96 or the fact that the slot 96 is unoccupied, in connection with the specific coordinates of the slot 96. Additional "locator" indicia 98, 100 are associated respectively with each slot 96 and with opposite ends of each tray 94. The article handling member 50 is further provided with a photosensor member 102 for locating these indicia and feeding the information back to the computer.

The automated terminal of the present invention is used for the purpose of purchasing or renting a videocassette article ("tape") as follows.

The user approaches the terminal and inserts a credit card into the reader slot 38. Upon receipt of acceptable information from the credit card, instructions for operation of the terminal are printed on the LED readout 42. The user is instructed to select the mode ("RENT", "PURCHASE" or "RETURN") in which he wishes the terminal to operate. If the user selects either the purchase or the rent mode, the user may be further instructed to choose the tape format desired (VHS or Beta, assuming both formats are available at this terminal). Upon selection of the tape format, the user will be instructed to punch the call number for the specific article desired into the finger panel 40. The call numbers are located on the display panel 24 containing the catalog information.

Upon receipt of the call number the computer directs the robot arm 16 to position the article handling member 50 in a position in alignment with an article acceptance slot 96 which the memory of the computer recalls as containing a copy of the user specified article, and as will be verified by optical reading of the corresponding indicia on the article and/or its case. The finger 80 of the gripper member 50 is extended by operation of the rack 72 and pinion gear 74 to engage the handle or lip 86 of the case 55 containing the desired tape and then retracted to remove the case from the tape acceptance slot. At this point, the optical reader verifies the identity of the article. Upon verification, the robot arm 16 returns to a position behind the chute 44 and inserts the case through the chute 44 to the user. A receipt is printed by the receipt printer 34 indicating the rental or purchase of the specified article and is extended to the user through the receipt slot 36.

It should be noted that an important aspect of the present invention is the self-programming robot arm 16 and its cooperation with a computer memory and the fact that there are no pre-assigned slots for any specific article. The robot arm 16 continuously re-programs the computer memory with respect to the location of all articles and all unoccupied slots 96. In operation, the bar code reader 52 receives information describing each article and supplies this information to the computer.

When a tape is returned, the user initially selects the return mode and tape format (if applicable) and then inserts the case into the chute. If the case is accepted, the bar code reader reads the code on the tape and/or its case. The computer memory, upon receipt of the bar code information, directs the robot arm 16 to place the article in any unoccupied slot 96. The robot arm 16 inserts the article into a slot 96 and the computer memory records the coordinates of that specific slot, thus preserving the slot location in correlation with the information contained on the tape and/or case. This feature greatly facilitates ease of stocking and restocking of the terminal. An attendant or caretaker, having a list of inventory desired to be removed from the terminal enters the call numbers for the specific articles and the computer instructs the robot arm 16 to remove each of the desired articles individually and return them to the caretaker through the chute 44. The attendant then places any new article inventory into the chute, the computer records the information contained on the bar code and the robot arm places the new inventory in empty slots 30 within the storage compartment 14, recording the locations of the slots selected and identity of the new inventory placed there.

Having described briefly some of the basic structure and operation of the present invention, reference is now invited in some further detail to the various drawings, so that further features may be described in yet further detail.

FIGS. 9 and 14 illustrate some further details of the motorized drive arrangement for the vertical lift assembly 48. As previously indicated, the motor 66 lifts and lowers the vertical lift assembly 48 by means of a belt 68 and counterbalance 70. More particularly, the motor is coupled with an overhead pulley 120 for driving the belt 68 through an assembly including respective speed reducing belt-driven pulleys 122, 124 and interconnecting belt 126. The latter pulley 122 is coupled to a transverse shaft 128 which is rotatively journalled in suitable bearing blocks 130, 132 for rotating the pulley member 120.

Moreover, the foregoing components are all mounted on a suitable mounting plate 135 which is mounted atop the vertical track member 46. This mounting plate also mounts a guide tube member 138 which received and guides the forward or return portion of the belt 68 therethrough. It will be seen that opposite ends of the belt are connected to the counter weight 70 and vertical lift assembly 48.

Figure 15:
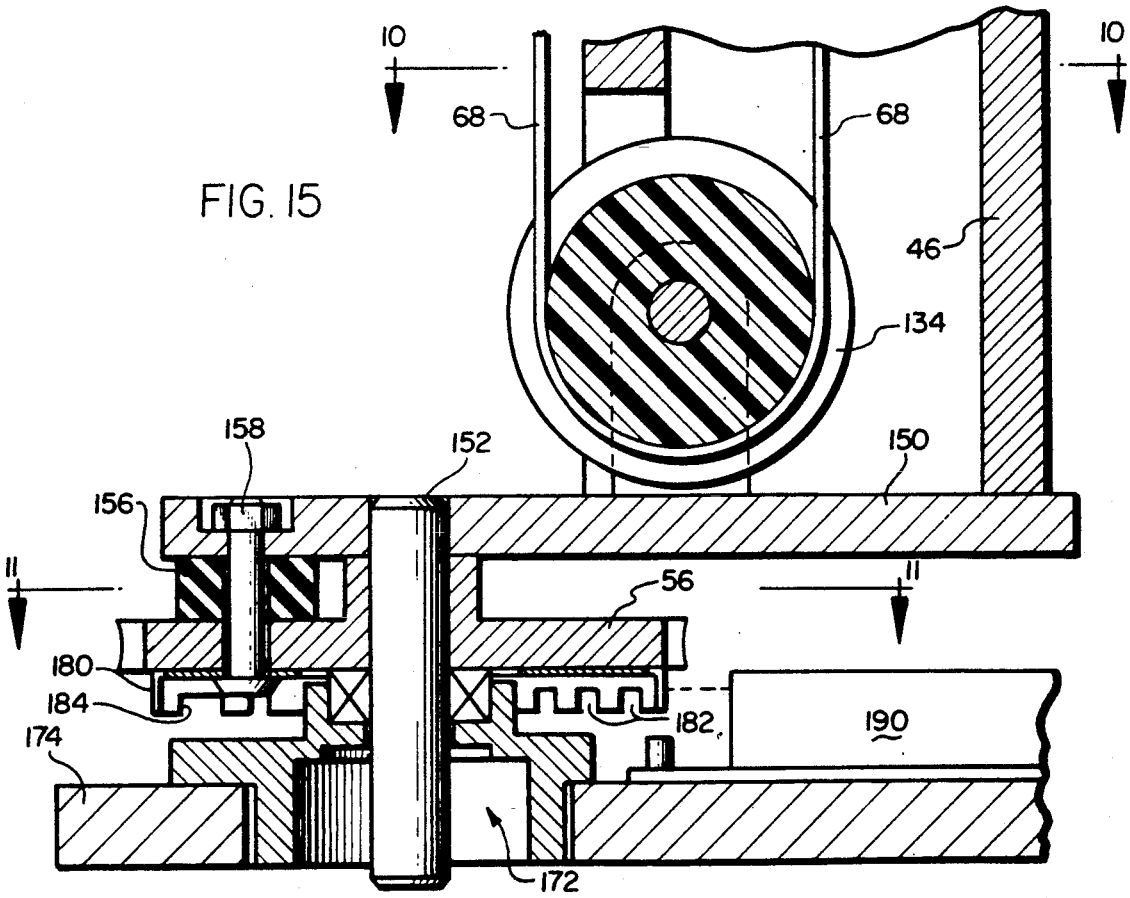
FIG. 15 is a partial sectional view taken generally along the line 15—15 of FIG. 10, and also indicating at 10—10 and 11—11 its relationship to the views of FIGS. 10 and 11.

Referring also briefly to FIG. 15, the opposite end of the belt 126 is looped about a bottom pulley 134 located at a bottom of the vertical track member 46.

Preferably, the motor 66 is an AC stepping motor, such that incremental units of motion of the vertical lift assembly 48 may be measured in terms of steps of the motor 66. These states may be counted by a suitable control portion of the computer 101 electrically coupled for driving the motor 66 in stepwise fashion. Additional position sensing means may also be operatively associated with the vertical drive arrangement for independently determining and thereby verifying the position of the article handling means on the vertical lift assembly 48. This may be done by providing additional position signals which may be compared with the motor step signals in the computer to verify correct positioning of the article handling means. This additional position sensing is preferably provided in the form of an additional elongate, stationary tape-like member 135 attached along the length of the extrusion forming the vertical track 46. The tape contains spaced black and white or other similar markings or interlineations thereon which may be viewed by a further photosensitive device or optical reader 140 (indicated only diagrammatically in FIG. 9) mounted on the body of the vertical lift assembly 48. This latter tape 135 and optical reader 140 are an alternate, optional feature and are therefore indicated only diagrammatically and only in the illustration of FIG. 9.

Preferably, the belt 68 is a relatively rigid timing-type of belt having accurate notches of equal angular spacing therein and the driven pulley 120 has a gear-like circumferential configuration for accurately driving the belt 68, as indicated somewhat diagrammatically in FIG. 14. A similar tape and reader combination may also be used, if desired, with respect to the horizontal motion of the article handling means 50, but the same has not been illustrated in detail herein. Rather, further details of the article handling assembly 50 and the vertical lift 48 upon which it is mounted are indicated in FIG. 16–18, to which further reference will be had later herein.

Referring now to FIGS. 10–13 and 15, further details of the rotational drive means and of the manner in which the vertical lift is attached thereto for rotation about a given vertical axis are illustrated. Referring initially to FIG. 10, the vertical track 46 will be seen to form a hollow elongate extrusion which is mounted to a generally flat, essentially rectangular plate 150 comprising a part of revolving assembly 54. The plate 150 caries the track 46 to one side thereof and to the other side thereof mounts a rigid shaft member 152. The shaft member 152 is mounted for rotating the plate 150 thereabout and hence defines the rotational axis thereof, as well as the axis about which vertical track 46 rotates. Additional shock absorbing mounting feet, preferably in the form of enlarged, grommet-like members 156 of rubber or similar elastomeric material in turn mount the plate to the large gear 56. In the illustrated embodiment, these elastomeric shock mounts are three in number and are mounted respectively to the plate 150 and gear 56 by elongate threaded fasteners 158 such as nuts and bolts.

As previously mentioned, the worm gear 58, rotated by motor 60, engages and rotates gear 56. In addition, the motor 60 is also an AC stepping or stepper motor (i.e. as described above with reference to motor 66). Accordingly, the rotation of the shaft 160 and hence of worm gear 158, gear 56 and ultimately the angular position or rotational movement of the entire assembly can be monitored by keeping track of the number of pulses or steps of the stepper motor 60 from a given zero reference or base line.

Preferably, the motor 60 is coupled for rotating worm gear 58 through an elongate, and preferably precision ground gear shaft 160, which runs entirely through worm gear 58 and is further rotatably journalled to either side thereof by heavy duty bearings 162, 163 mounted to a large, relatively rigid mounting frame 164. This frame 164 is additionally spring-loaded by means of a fixed block 166 and compression spring 168 so as to assure full contact between the gears 58 and 56 at all times.

Figure 12:
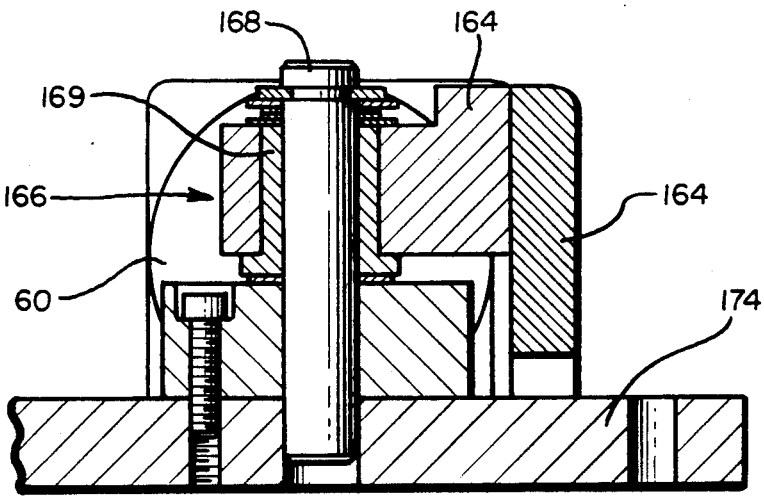
FIG. 12 is a sectional view taken generally along the line 12—12 of FIG. 11.

To this end, the frame or carriage 164 is also mounted for a limited degree of pivotal rotational motion about a pivot means or assembly 166 including an enlarged pivot shaft 168 and suitable bearing means 169 mounting the same to the frame 164 (see FIG. 12). It will be noted that motor 60 is not carried on the frame 164, but is provided with a flexible coupling 170 to accommodate the pivoting of frame 164.

Advantageously, the foregoing arrangement helps maintain essentially zero backlash or relative movement between the teeth of the gears 56, 58 by assuring that the same are in tight engagement at all times, the spring loading even compensating to a degree for relative wear in the gear teeth during operation over a long period of time.

Figure 13:
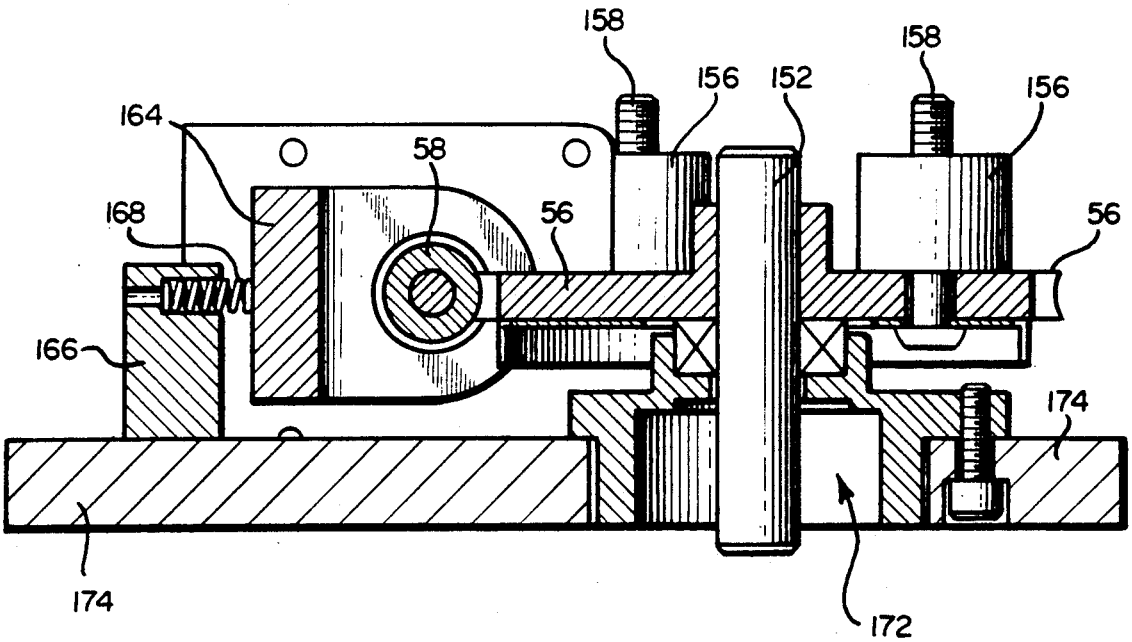
FIG. 13 is a sectional view taken generally along the line 13—13 of FIG. 11.

Referring also to FIG. 13, the shaft 152 is pressed into the gear 56 and also into a heavy duty bearing assembly 172 which is rigidly mounted to a platform or base member 174. Further, in order to provide a check on the angular position or rotational motion of gear 56 and hence of the vertical shaft assembly 46 and vertical lift assembly and article handling means 48, 50 an additional optical backup is provided. This backup takes the form of an inverted cup-like disk 180 which has a plurality of alternating teeth and notches 182 therein An optical sensor or photosensitive device 190 is positioned for viewing a side surface of this disk 180 as it rotates in unison with gear 56 to which it is suitably attached. A zero reference or home position may be provided by providing on the disk at least one relatively enlarged notch 184, as illustrated, or alternatively, one relatively enlarged tooth, i.e. "skipping" one of the regularly spaced notches 182 thereabout. Accordingly, as with the vertical drive system previously described, the computer 101 may receive and compare relative position signals both from stepper motor 60 and from optical sensor 190 and compare the same to assure accurate angular positioning of the article handling means relative to the individual articles within the respective slots 96.

As best viewed in FIG. 16, the drive arrangement for advancing and retracting the article handling means, and particularly the article-engaging finger 80 thereof, is coupled to be driven by motor 76 through an arrangement including a pulley 180 coupled to motor 76, a belt 182 and a second pulley 184 which is in turn coupled for rotation in unison with the pinion gear 74. Pinion gear 74 advances and retracts the slidably mounted rack member 72 as previously described. The entire assembly 48 is mounted for vertical motion relative to the elongate vertical track 46 by a system including rotating pairs of guide wheels 190 which embrace and run along a track-like edges 192 of the extrusion forming the vertical track 46. Additional guide members 196 may also be provided for embracing or otherwise running along complementary edges of the track 46 to assure essentially wobble-free engagement and movement of the vertical lift member 48 thereupon at all times. The rack member 72 is mounted to an elongate extrusion 200 which has track-like edges mounted for advancing and retracting horizontally between respective paired guide wheels or rollers 202, 204, coupled to a frame member or portion 206 of the vertical lift member or assembly 48. The article handling means or assembly 50 includes an elongate generally rectilinear open-topped and open-ended trough-like housing portion 210 for accepting a case 55. The housing or trough 210 preferably includes flared out leading side edge portions 212 and a somewhat flared or downwardly angled entrance lip 214 extending from a floor or bottom portion 216 thereof.

Referring again briefly to FIG. 6, accurate positioning for reliably engaging and retrieving and also for returning each case 55 with respect to a slot or receptacle 96 is accomplished by optically reading or locating the locator indicia 98, 100, and coordinating these locations with the accurate vertical and rotational motion obtained by the stepper motors and auxiliary optical sensor arrangement described above. Accordingly, at respective opposite ends of each arcuate shelf 94 is an enlarged and preferably white, square indicator mark 100. A similar preferably square, white indicator mark 98 is located at a fixed position relative to each compartment or slot 96.

In operation, the robot arm program contained in the computer 101 will, each time the unit is activated, direct movement of the robot arm to the theoretical and memorized center of each of the white squares 100 located at the ends of the respective shelves 94, and scan along respective edges of each square, checking the stored location thereof in terms of steps of each of motors 66, 76 against the previously memorized locations thereof, and making corrections if necessary. The computer is also pre-programmed with the number of steps of each motor between each shelf 94 and between each successive one of the compartments or slots 96.

Accordingly, upon ordering of one of the cassettes by a customer or attendant, the computer finds in memory the location of that item or article, and in particular, the location of the compartment or the slot in which it is stored, that is, the memorized coordinates in terms of motor steps to reach this location from a home or baseline, zero-reference position of the robot arm. The arm then returns to its baseline or home position and the necessary number of motor steps are executed to reach the theoretical center of the desired compartment or slot 96. Thereupon, the optical sensor 102 scans the associated locator square 98 and again checks the observed location thereof with the memorized location thereof in terms of memorized motor steps, and makes the necessary adjustment in position, if any, to accurately align the article handling apparatus 50 with the compartment 96 for removal of the case 55 therefrom.

The article handling apparatus will initially be positioned somewhat below center with respect to the case 55 so that the retrieval finger 98 may be fully advanced into registry with the lip or handle 86. Thereafter the vertical lift 48 is raised by the necessary amount to engage the finger 80 with the lip 86, whereupon the finger may be withdrawn so as to draw the desired article 55 into the trough or compartment 210. Thereupon the robot arm is rotated and lifted or lowered the amount necessary to place the same in registry with the delivery chute assembly 44.

In returning an article in its case 55 to storage, essentially the opposite operation is performed and the new location of the article is memorized once it is placed in an available slot or compartment 96.

In accordance with a preferred form of the invention, it will also be noted that the slot or opening of the delivery chute 44 (indicated, for example, in FIGS. 7 and 8 at reference numeral 220) is of unique dimensions, such that the case 55 is of complementary unique dimensions for interfitting therewithin. It should be noted that this combination of unique complimentary dimensions of opening 220 and case 55 make it difficult or even impossible to return an article which does not share these unique dimensions. In this regard, the chute assembly 44 is provided with further sensor means at respective margins of the opening 220 (diagrammatically illustrated at 222, 224 in FIG. 7), which must be tripped or activated in order to accept an article introduced therewithin. These sensors or other means may take the form of microswitches or the like which may be activated either directly or indirectly by means of suitably placed rollers, levers, linkages or the like, such that only an object of substantially the same dimensions as the cases or containers 55 will reliably activate all of these sensors and thereby indicate that an acceptable article has been placed within the opening 220 of the delivery chute 44. Accordingly, objects with larger dimensions simply will not fit within the entry and objects which have any one smaller dimension will fail to activate the suitable sensor and hence be rejected.

As a further advantage, the terminal of the present invention is capable of printing its own table of contents to be displayed on display panel 24. In this regard, the attendant or caretaker may command the receipt printer 32 to actually print in strip form the table of contents or catalog of articles for insertion in the display panel 24. It will be seen that the display panel 24 (see for example FIG. 1) includes a plurality of individual columns 224 which are sized to accept the individual strips 225 printed by the printer 32. The provision on the onboard computer 101 and its ability to read and identify the bar codes on individual articles, as well as memorize the location of each article in the storage compartments 96 makes this printing of the table of contents possible. As previously mentioned, the computer 101 may further communicate with a central control computer via a modem (not shown) to exchange various other information regarding the inventory on hand, condition of the inventory, frequency of rental of individual items and customer credit and account information.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to conver all such changes and modifications as fall within the true spirit and scope of the invention.

The invention is claimed as follows:

1. An automated machine for use in the storage, vending and receipt of articles comprising, in combination: an external wall having a delivery chute mounted thereto and extending therethrough, control means accessible for operation externally of said machine by a user to automatically stock, vend and selectively accept return of and re-stock, so that they can be re-vended, a plurality of reusable articles each having a unique code; storage means having a plurality of individual compartments, each for storing one of said plurality of articles; retrieval means movable relative to said storage means for retrieving user-selected articles from said compartments and for delivering the retrieved article to a user by way of said delivery chute, and for retrieving a returned article from said delivery chute and placing said returned article in an unoccupied one of said compartments; memory means for storing information corresponding to the location of said plurality of articles in said machine; code reader means mounted in said machine for reading the code of any article handled by the retrieval means and for generating an article code signal representation of the code so read, and transmitting said article code signal to said memory means; location signal generating means coupled to said retrieval means for generating a signal corresponding to the location of an article and for transmitting said article location signal to said memory means, whereby said memory means is updated with information corresponding to the article code and location of each article handled by said retrieval means; wherein said compartment means are arrayed in generally horizontally stacked, arcuate rows, each row extending over a major fractional portion of a circle and comprising a plurality of said compartment means in generally side-by-side array; and further including row indicia means and compartment indicia means associated respectively with said rows and with said compartments; indicia sensor means mounted to said retrieval means and responsive to said indicia means for producing position signals corresponding to the position of said retrieval means relative to said indicia means and for transmitting said position signals to said control means; wherein said indicia means include indicia for marking the location of each individual compartment; and wherein said control means further includes correction means for comparing the position signals produced in response to said indicia means to signals generated by said location signal generating means and for generating correction signals for correcting the position of said retrieval means to the extent necessary for properly aligning the retrieval means with each compartment for retrieving or replacing an article from or to said compartment.

2. A machine according to claim 1 wherein said retrieval means comprises a robotic arm apparatus comprising: a vertical track member; rotation drive means responsive to said control signals for revolving said vertical member about a given axis; a vertical lift member mounted for vertical axial movement on said vertical track member; vertical drive means responsive to said control signals for vertically moving said lift member relative to said vertical track member; article handling means mounted on said vertical lift member; horizontal drive means responsive to said control signals for extending and retracting said article handling means in a generally horizontal direction relative to said vertical lift member; and handling drive means responsive to said control signals for activating said article handling means to selectively engage and release one of said articles.

3. Apparatus according to claim 2 wherein said memory means retains information regarding the location of each said article within the machine, and, upon return of an article by a user, will automatically record the location to which said returned article is transported by said robotic arm apparatus.

4. Apparatus according to claim 2 wherein the user operated control means provides three distinct modes of operation, wherein the user may purchase the article, rent the article or return the article.

5. Apparatus according to claim 2 wherein said location signal generating means comprises angular position sensing means operatively associated with said rotational drive means for determining the angular position of said vertical track member and for providing corresponding angular position signals.

6. Apparatus according to claim 5 wherein said position sensing means comprises optical sensing means oriented for observing the rotational motion of said vertical track member and indicia means for quantifying said rotational motion.

7. Apparatus according to claim 5 wherein said vertical and rotational drive means comprise stepper motors and wherein said angular position sensing means include means for producing angular position signals corresponding to increments of rotation of each of said stepper motors.

8. Apparatus according to claim 6 wherein said indicia means include incremental markings located on said apparatus observable by said optical sensing means.

9. Apparatus according to claim 7 wherein said indicia means include incremental markings on said apparatus observable by said optical sensing means.

10. Apparatus according to claim 9 wherein said control means includes means for comparing the signals from said optical sensing means and said angular position signal producing means and for producing a malfunction signal in the event the two signals do not correspond to the same relative motion of said article handling means.

11. A machine according to claim 1 wherein each of said plurality of reusable articles is contained within a case; wherein said delivery chute has unique dimension; and wherein each said case has unique dimensions complementary with said delivery chute dimensions, such that any non-conforming case and/or articles cannot be introduced into the machine through said delivery chute.

12. A machine according to claim 11 and further including sensor means and rejecting means associated with said delivery chute for sensing and rejecting any article introduced thereto which does not have said unique dimensions of said case.

13. A machine according to claim 1 wherein said machine further includes a receipt printer operatively coupled with said memory means for printing receipts for customers upon rental and return of articles, said receipt printer and said memory means being further accessible by an authorized attendant for printing a table of contents of the articles inventoried in said machine for display upon said machine.

14. A machine according to claim 2, wherein said code reader means is mounted to said article handling means.

15. A machine according to claim 11 wherein said delivery chute is further provided with sensor means and means for activating said sensor means only in response to introduction into said delivery chute of a case having said unique dimensions for providing an indication that an acceptable article has been placed within the delivery chute.

16. A machine according to claim 1 wherein said retrieval means comprises a robotic arm apparatus comprising: a vertical track member; rotational drive means responsive to said control signals for revolving said vertical track member about a given axis; a vertical lift member mounted for vertical movement on said vertical track member; vertical drive means responsive to said control signals for vertically moving said lift member relative to said vertical track member; article handling means mounted on said vertical lift member; means responsive to said control signals for extending and retracting said article handling means in a generally horizontal direction relative to said vertical lift member; and means responsive to said control signals for activating said article handling means to selectively engage and release one of said articles.

17. Apparatus according to claim 5, wherein said location signal generating means comprises vertical position sensing means operatively associated with said vertical lift member for determining the vertical position thereof, and for providing corresponding vertical position signals.

18. Apparatus according to claim 17, wherein said vertical and rotational drive means comprise stepper motors and wherein said angular and vertical position sensing means include means for producing respective angular and vertical position signals corresponding to increments of rotation of each of said stepper motors in response to rotation thereof.

19. Apparatus according to claim 17, wherein said position sensing means comprises optical sensing means oriented for observing the vertical motion of said vertical lift member and indicia means for quantifying said vertical motion.

20. Apparatus according to claim 19, wherein said indicia means include incremental markings located on said apparatus and observable by said optical sensing means.

* * * * *

UNITED STATES PATENT AND TRADEMARK OFFICE

CERTIFICATE OF CORRECTION

PATENT NO. : 5,143,193

DATED : September 1, 1992

INVENTOR(S) : Ronald Geraci

It is certified that error appears in the above-identified patent and that said Letters Patent is hereby corrected as shown below:

Column 11, Line 67 "representation of" should read —representative of —

Column 12, Lines 20-21 "indicia for marking the location of each individual compartment;" should read —indicia for marking respective ends of each arcuate row and indicia means for marking the location of each individual compartment; —

Column 12, line 32, "rotation" should read --rotational--.

Signed and Sealed this

Twenty-third Day of November, 1993

*Attest:*

Bruce Lehman

BRUCE LEHMAN

*Attesting Officer*

*Commissioner of Patents and Trademarks*